US010214985B2

(12) United States Patent
Waldner et al.

(10) Patent No.: US 10,214,985 B2
(45) Date of Patent: Feb. 26, 2019

(54) PITLESS UNIT WITH NON-CORROSIVE MATERIAL ON WETTED SURFACES

(71) Applicant: SIM Enterprises Ltd., Lowe Farm (CA)

(72) Inventors: John Waldner, Lowe Farm (CA); James Waldner, Lowe Farm (CA); Silas Waldner, Lowe Farm (CA); John Little, Lowe Farm (CA); Eugene Gala, Lowe Farm (CA)

(73) Assignee: Sim Enterprises Ltd., Lowe Farm (CA)

( * ) Notice: Subject to any disclaimer, the term of this patent is extended or adjusted under 35 U.S.C. 154(b) by 83 days.

(21) Appl. No.: 15/425,459

(22) Filed: Feb. 6, 2017

(65) Prior Publication Data

US 2018/0223618 A1 Aug. 9, 2018

(51) Int. Cl.
*E21B 33/00* (2006.01)
*E21B 43/12* (2006.01)

(52) U.S. Cl.
CPC ..... *E21B 33/00* (2013.01); *E21B 43/121* (2013.01)

(58) Field of Classification Search
CPC ... E03B 3/10; E03B 5/04; E21B 33/00; E21B 43/121
See application file for complete search history.

(56) References Cited

U.S. PATENT DOCUMENTS 3,154,148 A * 10/1964 Peterson ..... E21B 33/00 166/85.2
4,416,328 A * 11/1983 Baski ..... E21B 33/00 166/65.1
4,620,660 A * 11/1986 Turner ..... B21C 29/006 228/127
5,439,052 A * 8/1995 Skinner ..... E21B 33/00 137/625.46
5,669,442 A * 9/1997 Gibson ..... E21B 33/00 166/85.2
5,746,273 A * 5/1998 Surinak ..... E21B 33/00 166/85.2
2010/0206553 A1* 8/2010 Bailey ..... E21B 17/042 166/244.1
2014/0287161 A1* 9/2014 Ertas ..... C23C 14/30 427/569

* cited by examiner

*Primary Examiner* — James G Sayre
(74) *Attorney, Agent, or Firm* — Adrian D. Battison; Ade + Company Inc.; Ryan W. Dupuis

(57) ABSTRACT

There is disclosed a connector which is sometimes referred to as a pitless unit in industry for use in a pumping system including a pump, well casing, a discharge pipe to guide liquid horizontally away from the pump, and a drop pipe to guide the liquid up from the pump towards the discharge pipe. The connector acts to connect the drop pipe and discharge pipe in fluidic communication while allowing the pump there beneath to be accessed from the surface of the ground. The connector features an outer housing and internal spool which is locatable in the housing in a seated position. An interior surface of the housing and surfaces of the spool which collectively define a chamber through which the liquid flows, when the spool is in the seated position, are weld cladded with a metallic cladding material so as to resist corrosion and erosion of these wetted surfaces of the connector.

11 Claims, 4 Drawing Sheets

PITLESS UNIT WITH NON-CORROSIVE MATERIAL ON WETTED SURFACES

FIELD OF THE INVENTION

The present invention relates to pitless units for pumping systems which are particularly suited for pumping water. A pitless unit forms a connector in such a pumping system allowing a pump at a bottom of a well to be accessed.

BACKGROUND

Pitless units are used throughout the world in potable water supply wells, booster pumping stations and geothermal (well to well) pumping applications. They form connectors each implemented at a well casing of the pumping system by which a pump at a bottom of the well may be accessed. Thus, water typically flows up from the pump, through the connector defined by the pitless unit, and downstream to a remainder of the pumping system.

Pitless units comprise a discharge housing and an internal spool. The surfaces of both components that are in contact with the water stream flowing through the connector, sometimes termed as the wetted surfaces of the pitless unit, are susceptible to corrosion over time. Maintaining the water purity also is considered important in water well applications including prevention of contamination and/or potential bacteria growth.

For example, in water supply wells, raw water typically contains a plurality of hard water ions which may effect corrosion on the pitless unit which is typically made of mild steel, alternatively termed carbon steel, which is susceptible to corrosion.

In booster station applications, where the water has already been treated commonly by reverse osmosis before passing through the pitless unit in the booster station, this form of treatment may cause the water to become corrosive.

There exist commercially available pitless units which are one of galvanized and epoxy coated so as to protect against corrosion. More specifically, in galvanization, a thin zinc based galvanized coating (approximately 0.00"-0.005" thick) onto the base metal typically which is carbon steel. In epoxy coating, a coating of NSF 61 approved epoxy (approximately 0.006" to 0.020" thick) is applied onto the surface of the base metal which forms each of the housing and spool.

However, there are some potential shortcoming associated with the above mentioned non-corrosive coatings. For example, these coatings are susceptible to chipping, often during installation of the connector, and de-bonding or delamination either of which may expose the base metal to contact with the water flowing through the connector.

Though areas of a coating which are chipped may be repaired by application of a painted coating in the field, the resulting coating including the original coating and the painted spots does not provide perform the same in terms of corrosion protection as a continuous and uninterrupted coating as originally applied. As such, premature corrosion and failure is more likely to result.

Further, it will be appreciated that in the case of galvanized pitless units, galvanized coatings inherently are sacrificial in nature and thus have limited service life.

Additionally, it will be appreciated that a quality of an epoxy coating is dependent on preparation of the base material prior to receiving the coating thereon. If a surface of the base material was not prepped properly the epoxy coating does not adhere thereto and the coating will delaminate or peel away over a period of time. Thus, with epoxy coatings there exists the possibility that the coating will break or spall during the service life of the connector.

The Applicant has developed a novel solution for a pitless unit which may have better non-corrosion performance than currently commercially available pitless units using galvanized or epoxy coatings for non-corrosion purposes.

SUMMARY OF THE INVENTION

According to one aspect of the invention there is provided a connector for a pumping system including:

a submersible pump located at a depth beneath a surface of the ground for pumping a liquid;

a well casing enclosing the submersible pump that extends upwardly therefrom to the surface of the ground;

a drop pipe connected to the submersible pump and extending upwardly towards the surface of the ground within the well casing;

an access opening at a top of the well casing that is closed by a well cap;

a lift out device provided at the access opening and extending downwardly therefrom towards the submersible pump within the well casing;

a discharge pipe for guiding the liquid pumped by the submersible pump to another location horizontally spaced from the submersible pump, the discharge pipe extending substantially horizontally in the ground at a depth which is above that of the submersible pump;

wherein the connector is disposed below the surface of the ground at a location intermediate the well cap and the submersible pump so as to connect the discharge pipe and the drop pipe in fluidic communication and such that there is a first portion of the well casing at least spanning from the submersible pump to the connector and a second portion of the well casing at least spanning from the connector to the access opening;

the connector comprising:

a housing having first, second, and third openings arranged in T shaped relation;

the housing at the first opening being connectable to the first portion of the well casing and at the second opening to the second portion of the well casing such that the housing is disposed in series between the first and second portions of the well casing;

an internal spool locatable in the housing in a seated position, the spool comprising a first end plate and a second end plate connected to each other in spaced relation and each located on either side of the third opening of the housing in the seated position;

the spool including at least one channel spanning between the first and second end plates that is communicated with an opening in each of the first and second end plate such that wires can be passed from a position at or adjacent an outer face of the first end plate through the at least one channel to a position at or adjacent an outer face of the second end plate so as to operatively couple the submersible pump and equipment at the access opening;

the first end plate supporting a tubular coupler communicated with an opening at an inner face of the first end plate with an open distal end of the tubular coupler which is at a spaced position beyond the outer face of the first end plate being connectable to the drop pipe so that the liquid flows from the submersible pump upwardly through the drop pipe and into the connector;

the housing at the third opening being connectable to the discharge pipe such that the liquid which flows into the connector from the submersible pump passes through a portion of the housing and out through the third opening such that an interior surface of the housing that extends from the third opening towards the second opening of the housing and inner faces of the first and second end plates of the spool that collectively define a chamber within the connector through which the liquid flows from the submersible pump to the discharge pipe are exposed to the liquid flowing through the connector;

the second end plate supporting a coupler for connecting to the lift out device such that the lift out device can be lifted to lift the spool out of the seated position in the housing and the drop pipe and the submersible pump connected thereto for accessing the submersible pump;

wherein the inner faces of the first and second end plates and said interior surface of the housing are weld cladded with a metallic cladding material.

Thus, wetted areas of the connector are weld cladded so as to resist corrosion and erosion effected by the liquid flowing therethrough.

Possibility of leaching from the connector into the liquid is reduced as well such that when the connector is implemented in a pumping system pumping water from underground wells for human consumption standards for drinking water (for example, NSF 61 in North America) may be maintained and contamination and/or potential bacteria grown may be prevented.

Additionally, various methods of attaching the well casing and the connector to one another may be employed as the weld cladding is sturdier/more rugged than interior surfaces of conventional connectors of this variety of structure which are galvanized or epoxy coated, and thus the weld cladding is not susceptible to damage during installation that may compromise the integrity of the interior surface. Thus, for example welded, flanged, or compression sleeve attachment methods each are suitable.

By the weld cladding the metallic cladding material is chemically fused with a base material forming a body of each of the housing and the spool.

Typically a base material forming the body of the housing and the body of the first and second end plates comprises carbon steel.

Preferably the metallic cladding material comprises nickel and chromium. Thus the cladding material is a form of stainless steel which may have different proportions of nickel and chromium and ratios thereof.

In other arrangements other metallic materials which are corrosion resistant may be used as the cladding material.

Typically the housing comprises a tubular body defining a first passageway with the first and second openings on opposite ends thereof and a second passageway extending from the third opening into communication with the first passageway at a location intermediate the first and second openings.

Typically the interior surface of the housing at the first passageway is shaped in a manner cooperating with the spool to receive the spool in the seated condition.

It is preferred that the interior surface of the housing which is weld cladded comprises the interior surface at the second passageway and at a portion of the first passageway between the first and second end plates of the spool in the seated position.

Preferably each of the first and second end plates of the spool comprises a circumferentially extending groove for receiving a sealing gasket to seal connection between an interior of the housing and the spool in the seated position, and an annular surface extending from the inner face of the respective one of the first and second end plates to the groove is weld cladded with the metallic cladding material.

A surface of said groove may also be weld cladded with the metallic cladding material.

The outer surface of each of the first and second end plates of the spool and an annular surface thereof extending from the inner face to the outer face may be weld cladded with the metallic cladding material. As such, an entirety of the outside surface of each first and second end plate may be weld cladded.

An interior surface of the housing from the first opening to the second opening is weld cladded with the metallic cladding material. As such, an entirety of the interior surface of the housing may be weld cladded.

In some arrangements the housing is exposed to a surrounding environment exterior to the well casing so that the connector is not enclosed by the well casing.

In other arrangements the connector may be substantially enclosed by the well casing such there is still formed the first and second portions of the well casing between which the connector is disposed in series, and there is a third portion of the well casing substantially surrounding the housing which in such an arrangement is substantially covered and thus substantially not exposed to the surrounding environment exterior to the well casing.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
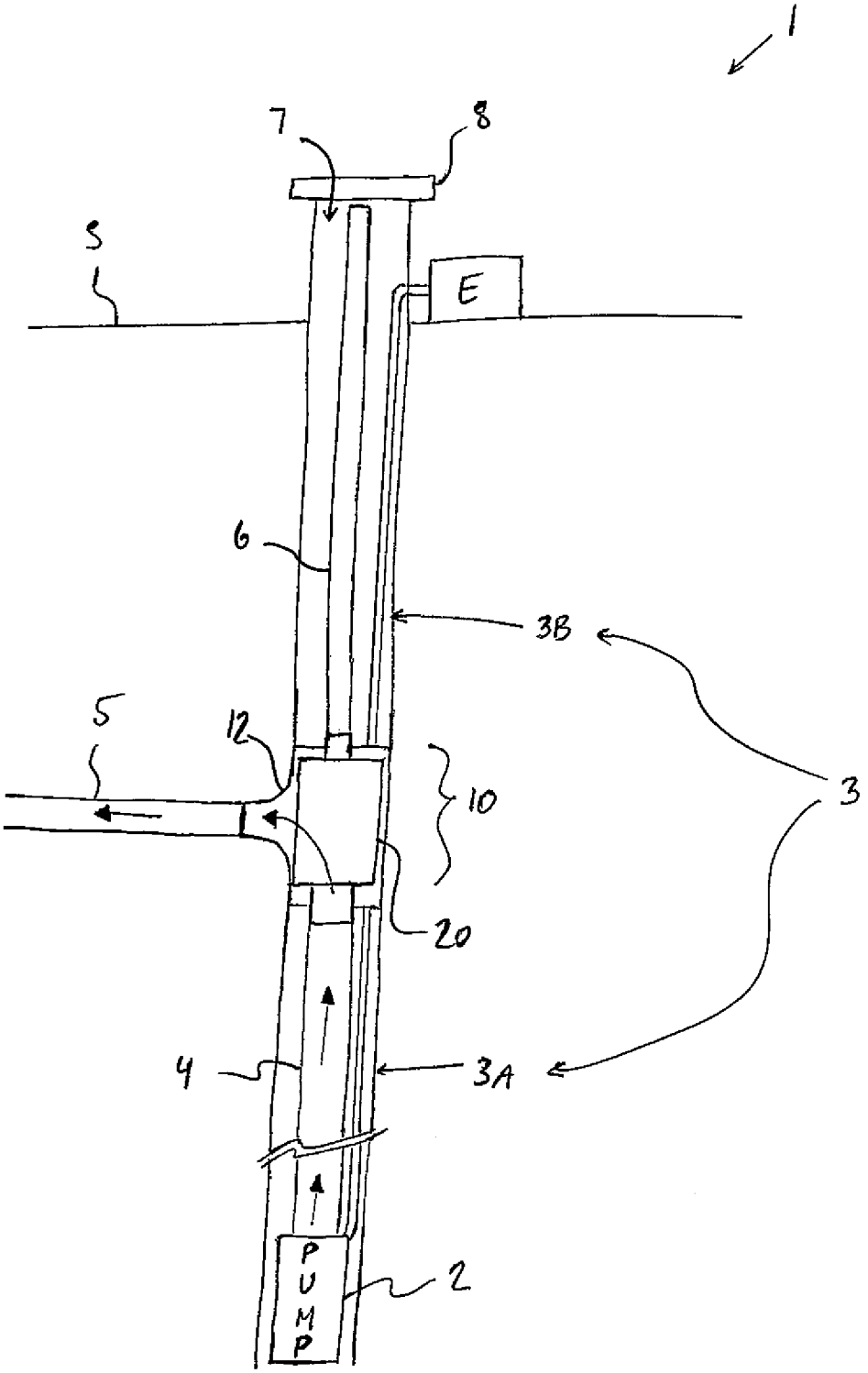
FIG. 1 is a schematic diagram of pumping system for pumping a liquid such as potable water, in which there is provided a connector according to the present invention.
Figure 2:
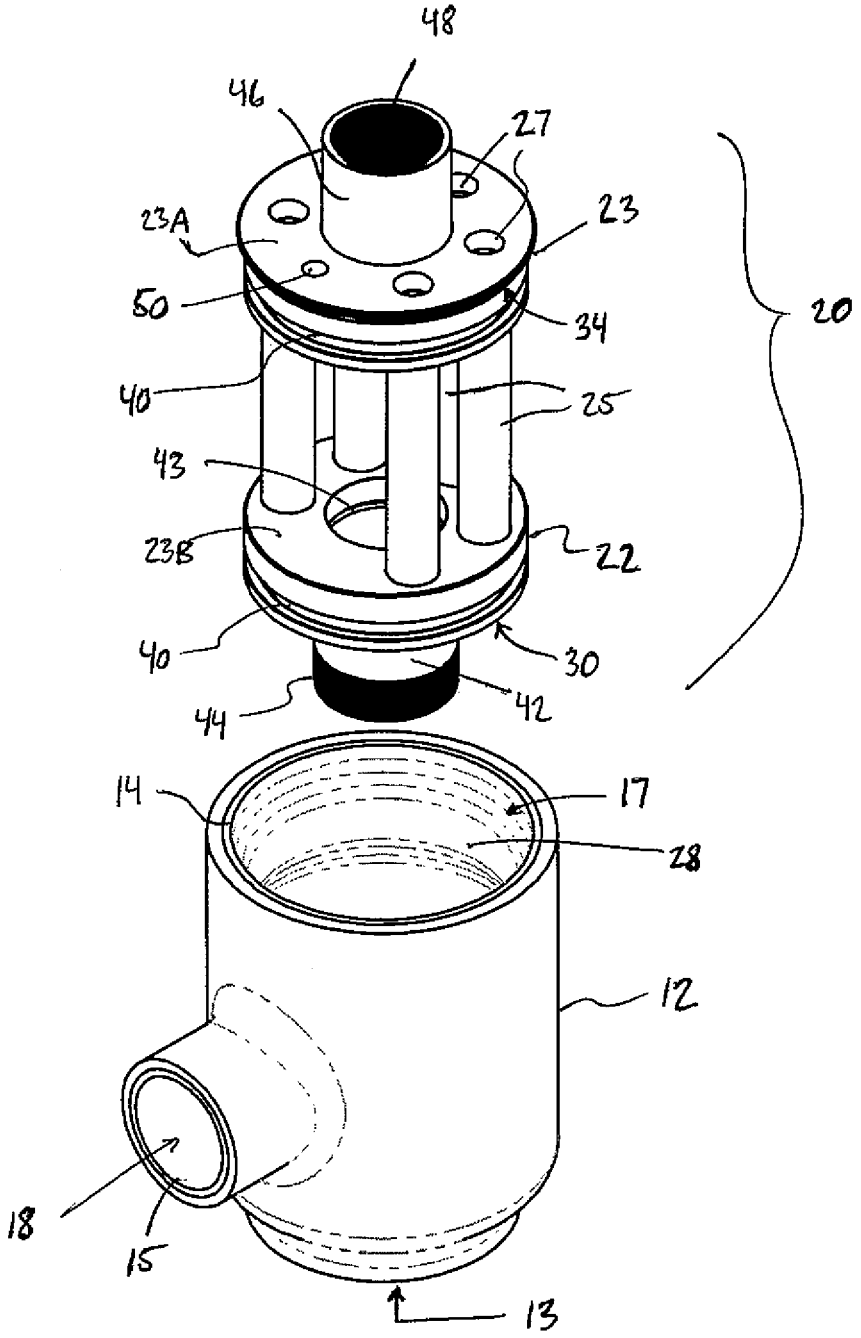
FIG. 2 is an exploded view of connector according to the present invention.

There is shown in the accompanying figures a connector generally indicated at reference numeral 10 for a pumping system 1 which is particularly suited for pumping water. The pumping system arranged in a manner similar to that as shown in FIG. 1 may also be used to pump other liquids, for example oil. Commonly, the connector 10 is referred to in industry as a pitless unit.

The pumping system 1 includes, as schematically shown in FIG. 1, a conventional submersible pump 2 which is located at a considerable depth beneath a surface S of the ground. When the pumping system serves a water supply function, the pump 2 extracts raw liquid which is stored at the considerable depth in the ground. The pumping system 1 may also serve a boosting function where the system forms part of a booster station in a water distribution network and is thus connected in a conventional, known manner to another pumping system from which the instant pumping system receives liquid. The instant pumping system 1 may also be connected to another pumping system in a well-to-well (geothermal) application in a conventional, known manner. In either one of these cases, the pump 2 moves the liquid upwardly as will be further described shortly.

The pump 2 is enclosed about its horizontal periphery by a well casing 3 which spans from the pump to the surface S of the ground. The well casing is formed in two portions 3A and 3B, which will be described in more detail shortly.

The liquid is pushed by the pump 2 upwardly through a pipe 4, typically termed a drop pipe, which is within the first bottom portion 3A of the well casing and extends from a bottom end of the drop pipe connected to an outlet of the pump 2 upwardly to a top end which is coupled to the connector 10 disposed at a depth in the ground above the submersible pump.

The connector 10 is located in line with and in series between the first bottom portion 3A and a second top portion 3B of the well casing. In the illustrated arrangement each portion of the well casing is formed by a length of metal tubing typically of uniform diameter.

At the connector 10 there branches off from the substantially vertical well casing 3 a discharge pipe 5 guiding the liquid pumped by the submersible pump 2 to another location which is horizontally spaced from the pump. Thus, the flow of the liquid is from the pump 2 where it originates in respect of the system 1, upwardly through the drop pipe 4, through the connector 10 and into the substantially horizontally extending discharge pipe 5 as shown by flow arrows in FIG. 1. In some implementations of the pumping system such as in water supply, the discharge pipe may form a water supply line delivering the water to a home.

Thus the connector 10 which is disposed below the surface S of the ground at a location intermediate a top of the well casing 3 and the pump 2 serves to connect the discharge pipe 5 and the drop pipe 4 in fluidic communication.

From a top of the connector 10 there extends upwardly within the second top portion of the well casing to a top of the well casing 3 at the surface of the ground a lift out device 6 with a top end arranged for gripping. The lift out device 6 is typically a pipe. At a bottom of the lift out device there may also be provided at least one torque arrestor (not shown) in connection with the connector 10 so as to resist undesirable rotation of the lift out device relative to the connector as connection therebetween is typically threadable.

At a top end of the second portion 3B of the well casing, defining the top of the well casing 3, there is formed an access opening 7 which is closed by a removable well cap 8. Conventional hold-down hooks may be provided with the lift out device at a top thereof, as understood by a person skilled in the art and thus not described in further detail herein.

Turning now in more detail to the connector 10 which is more clearly shown in FIGS. 2 to 5, the connector comprises an outer housing 12 which has three openings 13, 14, and 15 arranged in a T shape relative to each other. The housing itself is generally T shaped, too. More specifically, a first bottom opening 13 and a second top opening 14 are arranged in opposite longitudinal relation to one another along a first tubular passageway 17 of the housing, and there is a third side opening 15 at an end of a second tubular passageway 18 which extends perpendicularly transversely of the first passageway into communication therewith at a location centrally between the first and second openings 13, 14.

The housing 12 is arranged in line with the well casing 3 such that the housing at the first bottom opening 13 is connected to the first bottom portion 3A of the well casing and at the second top opening 14 to the second top portion 3B each for example by welding with rims of the housing at the first and second openings 13, 14 held in abutment with rims of the respective well casing portion 3A or 3B. In other arrangements which are not shown, the housing and the well casing portion 3A, 3B may be connected by mating of cooperating flanges disposed on each of the connector and the respective portion of well casing, or by a compression sleeve at the respective joint between the connector and the respective casing portion. In such an arrangement the housing 12 is exposed to a surrounding environment external to the well casing 3.

At the third side opening 15 the housing may be welded to the discharge pipe 5.

In other arrangements (not shown), the well casing substantially encompasses the connector 10 so as to cover the housing 12 such that the housing is not exposed to the surrounding environment. In such an arrangement the well casing includes a third portion substantially surrounding the housing and with an opening so that the housing at the third opening 15 can be connected to the discharge pipe 5. Such a third portion of the well casing may have a cross-section substantially the same in shape as the first and second portions 3A, 3B or alternatively it may be T-shaped like the housing 12.

Figure 3:
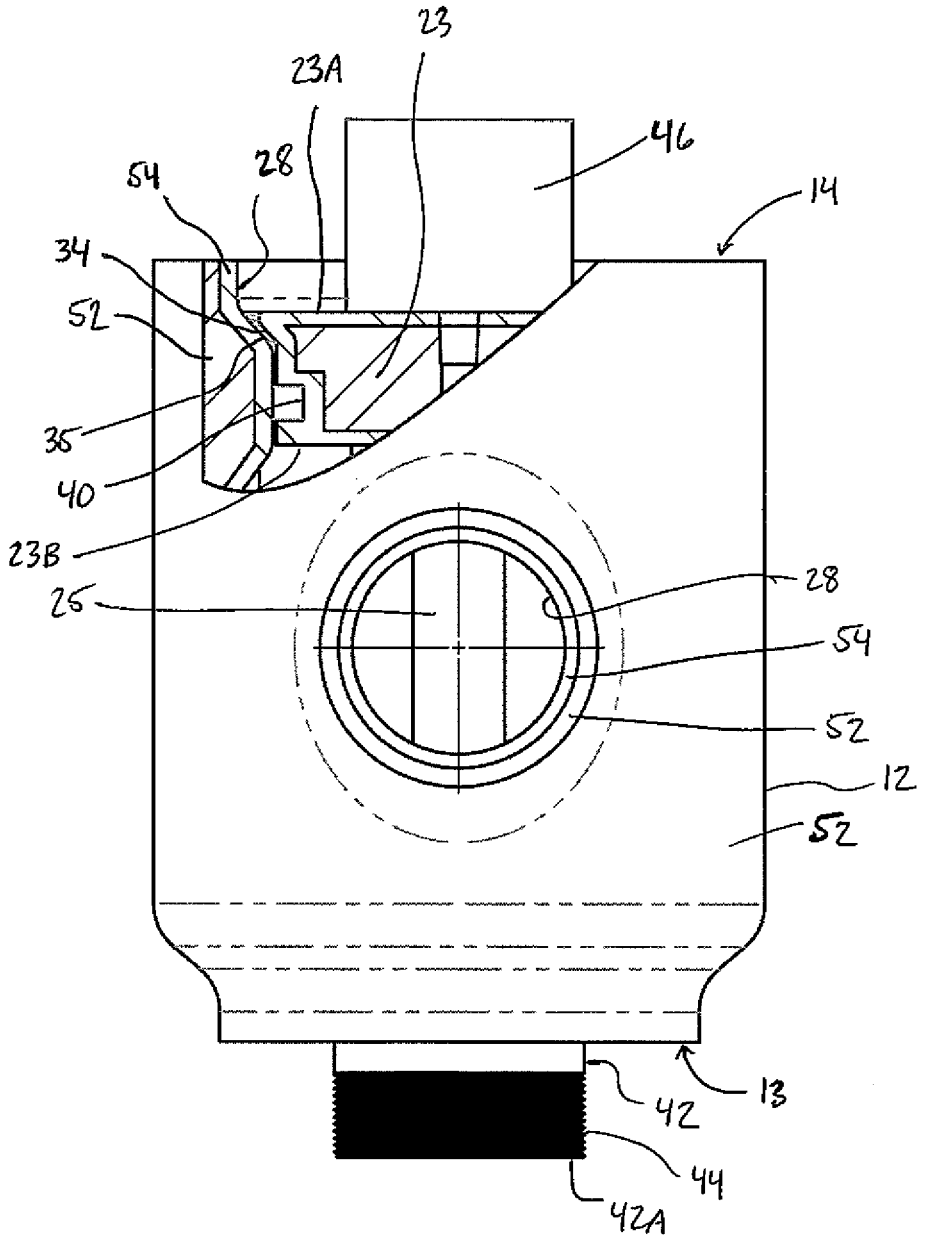
FIG. 3 is a side elevation view of the connector of FIG. 2 in which a spool is received in seated position in a housing of the connector and a portion of the housing and the spool is cutaway.
Figure 4:
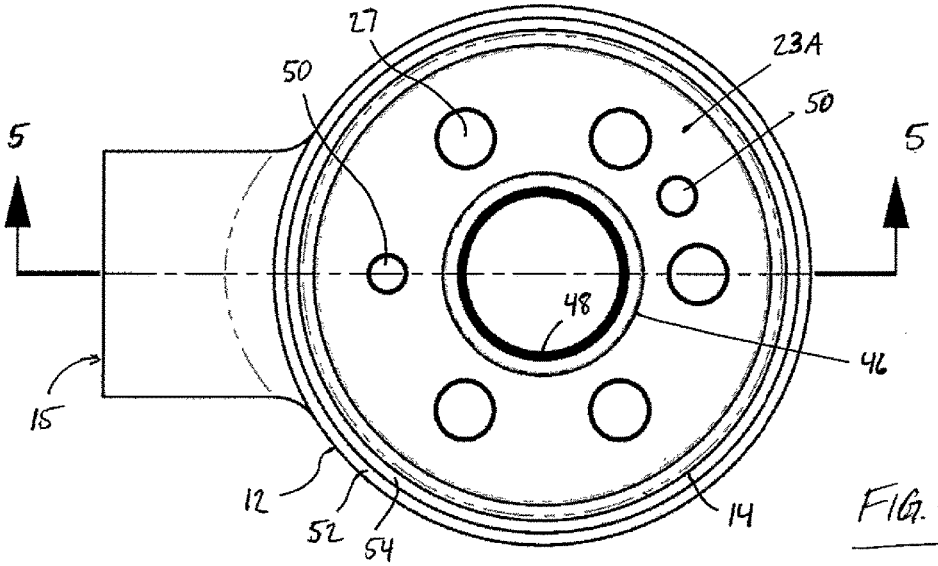
FIG. 4 is a top plan view of the connector as shown in FIG. 3.
Figure 5:
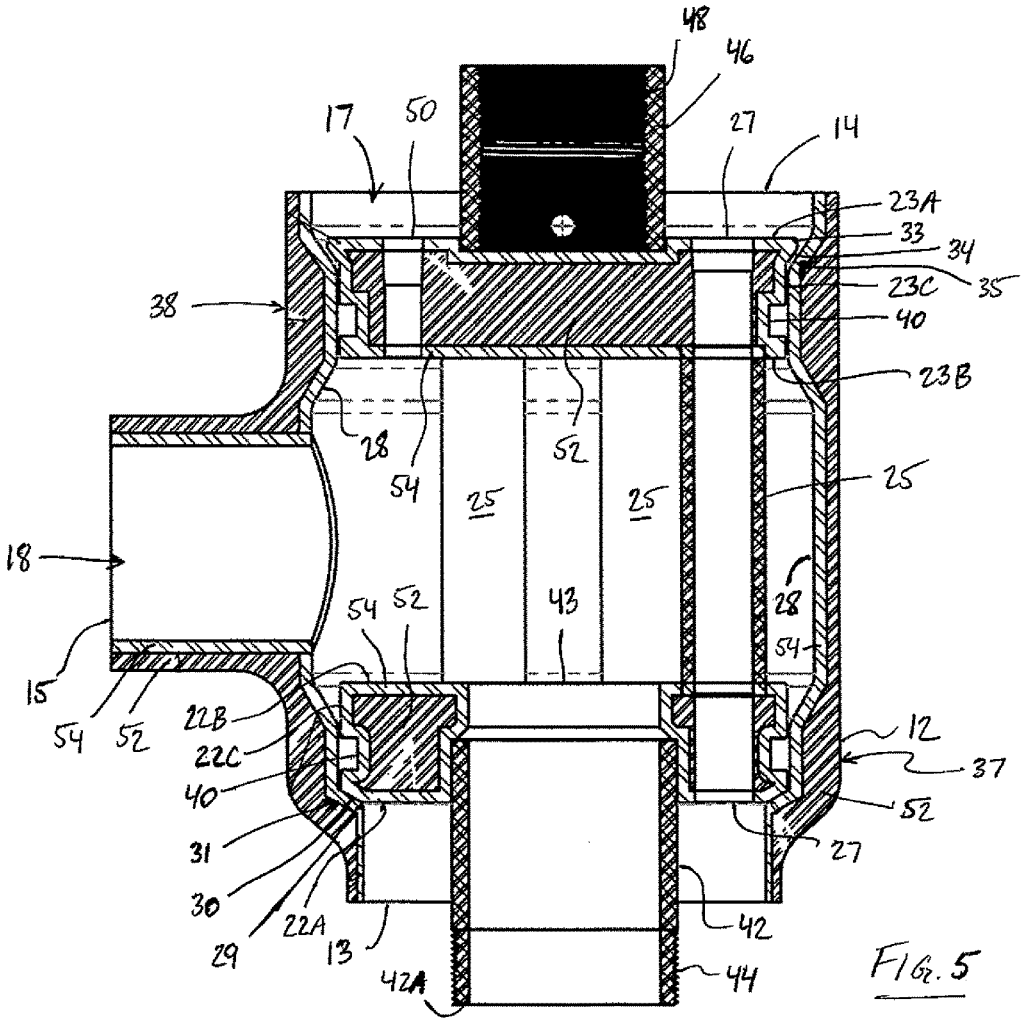
FIG. 5 is a cross-sectional view along line 5-5 in FIG. 4.

Further to the housing the connector 10 includes a spool 20 which is locatable within the housing 12 in a seated position as more clearly shown in FIGS. 3 and 5. The spool comprises a first end plate 22 and second end plate 23 held in spaced relation from one another along a longitudinal axis of the spool by a plurality of tubes 25 each spanning between the end plates at an angular spaced position from the next tube. Each of the tubes 25 has a hollow interior which is communicated with an opening 27 in each end plate such that wires and instruments may be passed from a position at or adjacent an outer face of one end plate, through the respective tube, and to a position at or adjacent an outer face of the opposite end plate. Thus the tubes 25 form channels or conduits for wiring and instruments so that the pump can be (electrically) connected to and operated by equipment E at the top of the well casing 3.

Each one of the end plates 22, 23 is circular in shape with an outer face, an inner face which is adjacent the second passageway 18 in the seated position, and an annular surface extending around a periphery of the end plate between the two faces.

Each end plate has an inclined surface for resting on a cooperating inclined portion of an interior surface 28 of the housing at the first passageway 17. More specifically, the annular surface 22C of the first end plate diverges outwardly from the longitudinal axis of the spool from a peripheral edge 29 of this plate's outer face to a spaced location closer to the outer face 23A than the inner face 23B of the second end plate, thus forming inclined surface 30 which rests on cooperating shoulder 31 of the housing interior surface. Similarly, the annular face 23C of the second end plate is inclined from a peripheral edge 33 at the outer face 23A to a location spaced inwardly towards the longitudinal axis of the spool thus forming inclined surface 34 which rests on a cooperating shoulder of the housing's interior surface that is indicated at 35.

Thus the interior surface 28 at the first passageway 17 of the housing is shaped in a manner cooperating with the spool to receive it in the seated position, including the shoulders 31 and 35 formed where the interior surface tapers at the two locations 37 and 38 along the first passageway from a first wider diameter to form a narrower diameter substantially equal to that of the end plates 22, 23. Between the locations 37 and 38 the interior surface 28 diverges back to its first wider diameter, but at each location 37, 38 the interior surface has the narrower diameter over a small length of the first passageway 17. The two locations of narrower diameter along the first passageway are located on either side of the third side opening 15 of the housing, and thus in the seated condition each end plate 22, 23 is located on either side of the third side opening.

Each end plate 22, 23 includes a circumferentially extending groove 40 located between its inner and outer faces for receiving a sealing gasket (not shown), such as an O-ring, for sealing connection between the annular surface 22C, 23C of the respective end plate and the interior surface 28 of the housing at the respective one of the locations 37, 38.

The spool further includes a tubular coupler 42 which is communicated with an opening 43 at the inner face 22B of the first end plate and which has an open distal end 42A of the coupler at a spaced position beyond the outer face 22A of the first end plate. The coupler 42 is threaded at 44 on its exterior surface so that at the coupler the drop pipe 4 is connectable to the connector 10, so that the water can flow from the outlet of the pump 2 upwardly through the drop pipe 4 and into a chamber of the connector which is defined by inner faces 22B, 23B of the first and second end plates (the spool is in the seated position) and that portion of the interior surface 28 of the housing along the first passageway which is located between the end plates 22, 23 in the seated position of the spool. The tubular coupler 42 may have varying transverse cross-section. Generally speaking, the coupler 42 is hollow along its length and open at either one of its ends so as to form a passageway for fluidically communicating the drop pipe 4 with the chamber of the connector so that water can flow through the coupler 42 from the pump up through the drop pipe and into the chamber of the connector.

Opposite the tubular coupler 42 there is provided another coupler 46 supported on the second end plate 23 for connecting to the lift out device 6. In the illustrated embodiment, the coupler 46 is tubular with uniform cross-section and has an interior surface which is threaded at 48 so as to threadably mate with the lift out device. As such, the lift out device 6 can be lifted to lift the spool 20 out of the seated position in the housing 12 and the drop pipe 4 and the submersible pump 2 connected thereto for accessing the pump.

In the illustrated embodiment there is provided in the second top end plate 23 a pair of openings 50 which are sized smaller than the openings 27 communicated with the tubes 25. At the openings 50 the user may install instrumentation such as a pressure gauge or sampling faucet (not shown) for measuring the liquid flowing through the connector. When no instrumentation is installed then the openings 50 are plugged, for example by rubber cylindrical plugs (not shown), so that the liquid does not leak out through these openings.

Most commonly, the housing 12 and the spool at its end plates 22, 23 are made from a base material 52 of carbon steel which is relatively inexpensive.

However, where the spool 20 and housing 12 become wetted, that is those surfaces of the spool and housing which are exposed to the liquid, these components due to their base material can be susceptible to corrosion which damages the components themselves and by which the liquid, in the illustrated embodiment water, may in turn become impure and unsuitable for its intended use.

Thus, at the least (i) the inner faces 22B, 23B of the end plates 22, 23 of the spool, (ii) the interior surface 28 of the housing between the two locations 37, 38 supporting the spool in the seated position and thus spanning between the inner faces 22B, 23B of the end plates, and (iii) the interior surface of housing at the second passageway 18 spanning from the third side opening 15 to the first passageway, each are weld cladded with a metallic cladding material 54 which is resistant to corrosion. (Generally speaking, the metallic cladding material has better corrosion-resistant properties than the base metallic material.) The metallic cladding material 54 comprises nickel and chromium in a selected one of a plurality of ratios thus forming one variant of stainless steel in a layer with a predetermined thickness on the base material 52. For example, suitable cladding material includes stainless steel (SS) 304, 308, 309, 316, 317, duplex, and super duplex. The metallic cladding material may have a layer thickness in a range between 0.065 and 0.125 inches, which is approximately ten times thicker than non-corrosive coatings such as galvanized or epoxy. For any one connector a specific one of the layer thicknesses for the cladding material may be chosen, that is the thickness of the cladding material layer may be controlled. By the weld cladding process it is easier to apply a uniform layer thickness of the cladding material as compared to prior art corrosion resistance in such connectors, like galvanized and epoxy coatings. Further, as the base material is weld cladded therewith, the cladding material is chemically fused with the base material, in other words unitary therewith, and therefore cannot delaminate from the base material.

Further to those surfaces specified above, the annular surfaces 22C, 23C of the end plates 22, 23 including the grooves 40 and the interior surface 28 of the housing at the location 37, 38 where the shoulders 31, 35 are formed are also weld cladded. An area between the end plates 22, 23 at their annular surfaces and the interior surface 28 of the housing may become wetted particularly if the sealing gasket disposed at the groove 40 is imperfect and thus preferably each such area is weld cladded with the non-corrosive cladding material too.

In the illustrated embodiment, an entirety of the interior surface 28 of the housing including a full length of the first passageway 17 from one end at the first opening 13 to the opposite end at the second opening 14 is weld cladded. Furthermore, the outer faces 22A and 23A of the end plates of the spool are weld cladded in the illustrated embodiment.

In other arrangements which are not shown, an exterior surface of the housing 12 may be cladded so as to resist corrosion with an external environment of the connector 10.

Weld cladding is significantly less expensive than manufacturing an entirety of the housing and the spool from a body of stainless steel.

The tubular couplers 42 for connecting to the drop pipe 4, which has an interior surface that is wetted, and the wiring conduit tubes 25 having their outer surfaces wetted each are typically made from stainless steel only. These components are sufficiently thin that the cost of fabrication from stainless steel versus the cost of cladding is relatively similar.

With weld cladding, the metallic cladding material may be applied in different thicknesses each suitable for the specific implementation, for example depending on the hardness of raw water when the connector is used in a water supply pumping system or in a well-to-well (geothermal) application or depending on a treatment method applied to the water when the connector is used in a booster station pumping system.

Application of the weld cladding may be performed manually by hand or using robots.

Therefore, by weld cladding, corrosion resistant materials may be provided only at surfaces of the connector which are wetted with a base material underlying the cladding material which does not have to be non-corrosive, thereby reducing a cost of the connector.

Further to corrosion resistance which protects against damage due to chemical action of the liquid on wetted interior surfaces of the connector, the cladding material is resistant to erosion which is damage due to the physical action of the liquid beating against interior surfaces of the connector 10 as the liquid flows therethrough. This is particularly important in the well-to-well (geothermal) application of the pumping system 1 and connector 10.

It will be appreciated that the connector 10 may be fabricated at a manufacturing facility. Alternatively, the connector according to the present invention may be formed from an existing, already manufactured connector that is subsequently modified by weld cladding of the interior surface of the housing 12 and appropriate faces of the end plates of the spool 20 so as to arrive at the present invention.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A connector for a pumping system including:

a submersible pump located at a depth beneath a surface of the ground for pumping a liquid;

a well casing enclosing the submersible pump that extends upwardly therefrom to the surface of the ground;

a drop pipe connected to the submersible pump and extending upwardly towards the surface of the ground within the well casing;

an access opening at a top of the well casing that is closed by a well cap;

a lift out device provided at the access opening and extending downwardly therefrom towards the submersible pump within the well casing;

a discharge pipe for guiding the liquid pumped by the submersible pump to another location horizontally spaced from the submersible pump, the discharge pipe extending substantially horizontally in the ground at a depth which is above that of the submersible pump;

wherein the connector is disposed below the surface of the ground at a location intermediate the well cap and the submersible pump so as to connect the discharge pipe and the drop pipe in fluidic communication and such that there is a first portion of the well casing at least spanning from the submersible pump to the connector and a second portion of the well casing at least spanning from the connector to the access opening;

the connector comprising:

a housing comprising a generally T-shaped tubular carbon steel body having opposite first and second openings, and a third opening arranged in T shaped relation to the first and second openings;

the housing at the first opening being connectable to the first portion of the well casing and at the second opening to the second portion of the well casing such that the housing is disposed in series between the first and second portions of the well casing;

an internal spool locatable in the housing in a seated position in which the spool guides liquid flowing through the housing, the spool comprising a first end plate and a second end plate connected in spaced relation to one another and each located on either side of the third opening of the housing in the seated position;

the first and second end plates of the spool being adapted to respectively form a seal with the housing at a first location on an interior of the housing between the first and third openings and a second location on the interior of the housing between the second and third openings when the spool is received in the seated position of the spool;

the interior of the housing being tapered on either side of each of the first and second locations to define a reduced diameter at each of the first and second locations where the first and second end plates of the spool are adapted to respectively form the seal;

the spool including at least one channel spanning between the first and second end plates that is communicated with an opening in each of the first end plate and the second end plate such that wires can be passed from a position at or adjacent an outer face of the first end plate through the at least one channel to a position at or adjacent an outer face of the second end plate so as to operatively couple the submersible pump and equipment at the access opening;

the first end plate supporting a tubular coupler communicated with an opening at an inner face of the first end plate with an open distal end of the tubular coupler which is at a spaced position beyond the outer face of the first end plate being connectable to the drop pipe so that the liquid flows from the submersible pump upwardly through the drop pipe and into the connector;

the second end plate supporting a coupler for connecting to the lift out device such that the lift out device can be lifted to lift the spool out of the seated position in the housing and the drop pipe and the submersible pump connected thereto for accessing the submersible pump;

the housing at the third opening being connectable to the discharge pipe such that the liquid which flows into the connector from the submersible pump passes through a wetted portion of the interior of the housing and out at the third opening, the wetted portion of the interior being delimited by the third opening and on either side thereof by the first and second locations on the housing interior that sealinqly engage the spool at the first and second end plates when the spool is received in the seated position;

surfaces of the first and second end plates and said at least one channel of the spool that are exposable to the liquid flowing through the connector being adapted in a manner so as to be non-corrosive to ground water;

wherein an interior surface of the carbon steel body is shaped to define the first and second locations on the interior of the housing that sealingly engage the spool when received in the seated position;

wherein the wetted portion of the interior of the housing, which is delimited by the third opening and on either side thereof by the first and second locations on the interior of the housing, comprises a layer of metallic cladding material, which includes stainless steel;

a thickness of the layer of the metallic cladding material being arranged so as to collectively define with the carbon steel body the reduced diameter at each of the first and second locations; and the layer of the metallic cladding material being weld cladded to the carbon steel body and following the shape of the interior of the housing as defined by the carbon steel body.

2. The connector according to claim 1 wherein the first and second end plates each comprise a carbon steel body which is weld cladded with-metallic cladding material that comprises stainless steel.

3. The connector according to claim 1 wherein a whole of the interior of the housing from the first opening to the second opening and to the third opening, including the wetted portion, is weld cladded with the metallic cladding material.

4. The connector according to claim 1 wherein the layer of the metallic cladding material has a thickness in a range between 0.065 and 0.125 inches.

5. The connector according to claim 1 wherein the thickness of the layer of the metallic cladding material is uniform.

6. The connector according to claim 1 wherein the stainless steel comprises stainless steel 304.

7. The connector according to claim 1 wherein:

the first and second end plates comprise a base material which is more corrosive to ground water than stainless steel;

wherein each of the first and second end plates comprises a circumferentially extending groove for receiving a sealing gasket to sealingly engage the interior of the housing at the first and second locations when the spool is received in the seated position; and wherein the inner face of the first end plate of the spool and an inner face of the second end plate which is opposite thereto, an annular surface extending from the inner face of the respective one of the first and second end plates to the groove, and a surface of said groove are weld cladded with-metallic cladding material that comprises stainless steel.

8. A connector for a pumping system including:

a submersible pump located at a depth beneath a surface of the ground for pumping a liquid;

a well casing enclosing the submersible pump that extends upwardly therefrom to the surface of the ground;

a drop pipe connected to the submersible pump and extending upwardly towards the surface of the ground within the well casing;

an access opening at a top of the well casing that is closed by a well cap;

a lift out device provided at the access opening and extending downwardly therefrom towards the submersible pump within the well casing;

a discharge pipe for guiding the liquid pumped by the submersible pump to another location horizontally spaced from the submersible pump, the discharge pipe extending substantially horizontally in the ground at a depth which is above that of the submersible pump;

wherein the connector is disposed below the surface of the ground at a location intermediate the well cap and the submersible pump so as to connect the discharge pipe and the drop pipe in fluidic communication and such that there is a first portion of the well casing at least spanning from the submersible pump to the connector and a second portion of the well casing at least spanning from the connector to the access opening;

the connector comprising:

a housing comprising a generally T-shaped tubular carbon steel body having opposite first and second openings, and a third opening arranged in T shaped relation to the first and second openings;

the housing at the first opening being connectable to the first portion of the well casing and at the second opening to the second portion of the well casing such that the housing is disposed in series between the first and second portions of the well casing;

an internal spool locatable in the housing in a seated position in which the spool guides liquid flowing through the housing, the spool comprising a first end plate and a second end plate connected in spaced relation to one another and each located on either side of the third opening of the housing in the seated position;

the first and second end plates of the spool being adapted to respectively form a seal with the housing at a first location on an interior of the housing between the first and third openings and a second location on the interior of the housing between the second and third openings when the spool is received in the seated position of the spool;

the interior of the housing being tapered on either side of each of the first and second locations to define a reduced diameter at each of the first and second locations where the first and second end plates of the spool are adapted to respectively form the seal;

the spool including at least one channel spanning between the first and second end plates that is communicated with an opening in each of the first end plate and the second end plate such that wires can be passed from a position at or adjacent an outer face of the first end plate through the at least one channel to a position at or adjacent an outer face of the second end plate so as to operatively couple the submersible pump and equipment at the access opening;

the first end plate supporting a tubular coupler communicated with an opening at an inner face of the first end plate with an open distal end of the tubular coupler which is at a spaced position beyond the outer face of the first end plate being connectable to the drop pipe so that the liquid flows from the submersible pump upwardly through the drop pipe and into the connector;

the second end plate supporting a coupler for connecting to the lift out device such that the lift out device can be lifted to lift the spool out of the seated position in the housing and the drop pipe and the submersible pump connected thereto for accessing the submersible pump;

the housing at the third opening being connectable to the discharge pipe such that the liquid which flows into the connector from the submersible pump passes through a wetted portion of the interior of the housing and out at the third opening, the wetted portion of the interior being delimited by the third opening and on either side thereof by the first and second locations on the housing interior that sealingly engage the spool at the first and second end plates when the spool is received in the seated position;

surfaces of the first and second end plates and said at least one channel of the spool that are exposable to the liquid flowing through the connector being adapted in a manner so as to be non-corrosive to ground water;

wherein a whole interior surface of the carbon steel body from the first opening to the second opening and to the third opening is weld cladded with metallic cladding material comprising stainless steel so as to define the interior of the housing, such that the whole interior of the housing, including the wetted portion, comprises the metallic cladding material.

9. A connector for a pumping system including:

a submersible pump located at a depth beneath a surface of the ground for pumping a liquid;

a well casing enclosing the submersible pump that extends upwardly therefrom to the surface of the ground;

a drop pipe connected to the submersible pump and extending upwardly towards the surface of the ground within the well casing;

an access opening at a top of the well casing that is closed by a well cap;

a lift out device provided at the access opening and extending downwardly therefrom towards the submersible pump within the well casing;

a discharge pipe for guiding the liquid pumped by the submersible pump to another location horizontally spaced from the submersible pump, the discharge pipe extending substantially horizontally in the ground at a depth which is above that of the submersible pump;

wherein the connector is disposed below the surface of the ground at a location intermediate the well cap and the submersible pump so as to connect the discharge pipe and the drop pipe in fluidic communication and such that there is a first portion of the well casing at least spanning from the submersible pump to the connector and a second portion of the well casing at least spanning from the connector to the access opening;

the connector comprising:

a housing comprising a generally T-shaped tubular body having opposite first and second openings, and a third opening arranged in T shaped relation to the first and second openings;

the housing at the first opening being connectable to the first portion of the well casing and at the second opening to the second portion of the well casing such that the housing is disposed in series between the first and second portions of the well casing;

an internal spool locatable in the housing in a seated position in which the spool guides liquid flowing through the housing, the spool comprising a first end plate and a second end plate connected in spaced relation to one another and each located on either side of the third opening of the housing in the seated position;

the first and second end plates of the spool being adapted to respectively form a seal with the housing at a first location on an interior of the housing between the first and third openings and a second location on the interior of the housing between the second and third openings when the spool is received in the seated position of the spool;

the interior of the housing being tapered on either side of each of the first and second locations to define a reduced diameter at each of the first and second locations where the first and second end plates of the spool are adapted to respectively form the seal;

each of the first and second end plates comprising a circumferentially extending groove for receiving a sealing gasket to sealingly engage the interior of the housing at the first and second locations when the spool is received in the seated position;

the spool including at least one channel spanning between the first and second end plates that is communicated with an opening in each of the first end plate and the second end plate such that wires can be passed from a position at or adjacent an outer face of the first end plate through the at least one channel to a position at or adjacent an outer face of the second end plate so as to operatively couple the submersible pump and equipment at the access opening;

the first end plate supporting a tubular coupler communicated with an opening at an inner face of the first end plate with an open distal end of the tubular coupler which is at a spaced position beyond the outer face of the first end plate being connectable to the drop pipe so that the liquid flows from the submersible pump upwardly through the drop pipe and into the connector;

the second end plate supporting a coupler for connecting to the lift out device such that the lift out device can be lifted to lift the spool out of the seated position in the housing and the drop pipe and the submersible pump connected thereto for accessing the submersible pump;

the housing at the third opening being connectable to the discharge pipe such that the liquid which flows into the connector from the submersible pump passes through a wetted portion of the interior of the housing and out at the third opening, the wetted portion of the interior being delimited by the third opening and on either side thereof by the first and second locations on the housing interior that sealingly engage the spool at the first and second end plates when the spool is received in the seated position;

the wetted portion of the interior of the housing being adapted in a manner so as to be non-corrosive to ground water;

a surface of said at least one channel of the spool which is exposable to the liquid flowing through the connector being adapted in a manner so as to be non-corrosive to ground water; and wherein the first and second end plates comprise a base material which is more corrosive to ground water than stainless steel; and wherein the inner face of the first end plate of the spool and an inner face of the second end plate which is opposite thereto, an annular surface on each of the first and second end plates extending from the inner face of the respective one of the first and second end plates to the groove, and a surface of said groove of each of the first and second end plates are weld cladded with metallic cladding material that comprises stainless steel.

10. The connector of claim 9 wherein the base material of the first and second end plates is carbon steel.

11. The connector of claim 9 wherein a whole surface of each of the first and second end plates is weld cladded with the metallic cladding material.

* * * * *